US007753130B2

(12) United States Patent
Cote

(10) Patent No.: US 7,753,130 B2
(45) Date of Patent: Jul. 13, 2010

(54) METHOD AND TOOL FOR PLACING A WELL BORE LINER

(75) Inventor: Bradley R. Cote, Calgary (CA)

(73) Assignee: BBJ Tools Inc., Calgary (CA)

( * ) Notice: Subject to any disclaimer, the term of this patent is extended or adjusted under 35 U.S.C. 154(b) by 220 days.

(21) Appl. No.: 11/308,398

(22) Filed: Mar. 21, 2006

(65) Prior Publication Data

US 2007/0023192 A1 Feb. 1, 2007

Related U.S. Application Data

(60) Provisional application No. 60/594,224, filed on Mar. 21, 2005.

(51) Int. Cl.
*E21B 43/10* (2006.01)

(52) U.S. Cl. ..... 166/387; 166/380; 166/381; 166/382; 166/202

(58) Field of Classification Search ..... 166/387, 166/180, 242.2, 380, 381, 382, 202
See application file for complete search history.

(56) References Cited

U.S. PATENT DOCUMENTS 2,998,065 A * 8/1961 Hildebrandt ..... 166/278
5,044,442 A 9/1991 Nobileau
5,117,915 A 6/1992 Mueller et al.
5,743,335 A * 4/1998 Bussear ..... 166/285
5,746,274 A * 5/1998 Voll et al. ..... 166/278
5,829,526 A 11/1998 Rogers et al.
6,138,761 A 10/2000 Freeman et al.
6,318,472 B1 11/2001 Rogers et al.
6,719,064 B2 * 4/2004 Price-Smith et al. ..... 166/387
6,725,934 B2 * 4/2004 Coronado et al. ..... 166/313
6,808,024 B2 * 10/2004 Schwendemann et al. ... 166/387
2003/0070816 A1 4/2003 Sullaway et al.
2003/0116324 A1 6/2003 Dawson et al.
2003/0116325 A1 * 6/2003 Cook et al. ..... 166/382
2003/0188874 A1 10/2003 Gabrysch et al.
2004/0026091 A1 2/2004 Patel et al.
2007/0000664 A1 * 1/2007 Ring et al. ..... 166/277

* cited by examiner

*Primary Examiner*—Jennifer H Gay
*Assistant Examiner*—Brad Harcourt
(74) *Attorney, Agent, or Firm*—Bennett Jones LLP

(57) ABSTRACT

A well bore liner placement method and apparatus, including inserting a liner running assembly carrying a liner into a well bore, the assembly including a liner placement apparatus having an annular seal extending radially to sealingly engage the well bore, and pumping fluid into the annulus above the annular seal until fluid pressure on the upper surface area of the annular seal creates a force exceeding opposing bottom-hole forces below the annular seal and thereby driving the liner down the well bore.

8 Claims, 2 Drawing Sheets

METHOD AND TOOL FOR PLACING A WELL BORE LINER

FIELD OF THE INVENTION

The present invention relates to well bore liner placement methods and tools.

BACKGROUND

When running in a well bore liner, such as for example, a slotted liner, the liner is run in using force applied from surface. The liner is often run in through surface cased portions of the well bore and then into open hole. The liner is often mounted adjacent its uphole end to a liner hanger and thereabove a tubing string, for example, including a plurality of interconnected of tubulars, such as drill pipe. As the liner reaches increased depths, the surface manipulation may become less effective, and the drill pipe above the liner hanger may begin to buckle rather than communicating the force to move the liner to total depth.

As such, often a liner placement procedure must be ceased before the liner actually reaches an optimal depth. Thus, a portion of the well bore may remain unlined, which is economically undesirable.

SUMMARY

In the following description of the invention, it is to be understood that although the reference is made a borehole and/or well bore and the wall of the borehole and/or well bore, it is to be understood that the borehole could be open hole or lined. For example, the terms borehole/well bore have been used to include cased boreholes and the term borehole wall in that case would actually be the inner surface of the casing lining the well bore.

In one aspect of the present invention, there is provided a liner placement tool for use in a well bore, including a tool body and an annular seal extending radially about the tool body for sealingly engaging the well bore, the tool body having a lower end engageable with a well bore liner. The tool may include an axial channel extending from the lower end to an upper end, which may further be fluid-communicatingly engageable with a tubing string.

In another aspect of the invention, there is provided a system for assisting the placement of a well bore liner in a borehole, the system comprising: a liner retainer, a liner placement assist tool connectable to the liner retainer including a tool body, an inner axial channel extending through the tool body and an annular seal extending radially about the tool body, an upper end on the apparatus for accepting connection of a tubing string, and a lower end on the apparatus for accepting connection of a well bore liner.

In yet another aspect of the invention, there is provided a method of placing a well bore liner, comprising inserting a liner running assembly from surface into a well bore and defining an annulus between the liner running assembly and the well bore, the liner running assembly comprising a liner placement apparatus having an annular seal with an upper surface area, the annular seal extending radially about the liner placement apparatus for sealingly engaging the well bore, the liner placement apparatus engaging at an upper end thereof a tubing string and engaging at a lower end thereof a well bore liner, and the well bore having an inlet at surface; running the liner running assembly to a selected depth; packing off the annulus above the inlet; pumping fluid into the annulus through the inlet above the annular seal until fluid pressure on the upper surface area of the annular seal creates a force at least equal to opposing bottomhole forces below the annular seal; continuing to pump fluid into the annulus through the inlet to drive the liner down the well bore. In accordance with a method of the invention, the annular seal is selected to create a seal between the tubing string and the well bore wall capable of holding pressure in the annulus between the tubing string and the wall, creating a high fluid pressure region in the annulus above the annular seal which, in combination with the upper surface area of the annular seal upon which such fluid pressure acts, creates a downward force sufficient to overcome opposing forces which would inhibit downward movement of the liner (such as liner, or down, drag) below the annular seal to thereby drive the liner into the borehole.

In another aspect of the present invention, there is provided a method for running a well bore liner into a borehole comprising: providing a liner and liner running assembly including a tubing string, a liner retainer for holding the liner in place in the borehole (such as, for example, a liner hanger or packer) attached adjacent a lower end of the tubing string, and an annular seal selected to sealingly couple the liner running assembly and the borehole wall, running the liner and liner running assembly into the well bore, applying force to the tubing string to move the liner into the well bore, pumping fluid into an annulus between the tubing string and the borehole wall to exert a fluid pressure on the upper surface area of the annular seal thereby creating a downward force on the annular seal greater than opposing forces below the annular seal such that the annular seal begins to act as a piston to drive the liner further into the borehole.

DETAILED DESCRIPTION OF VARIOUS EMBODIMENTS

Figure 1:
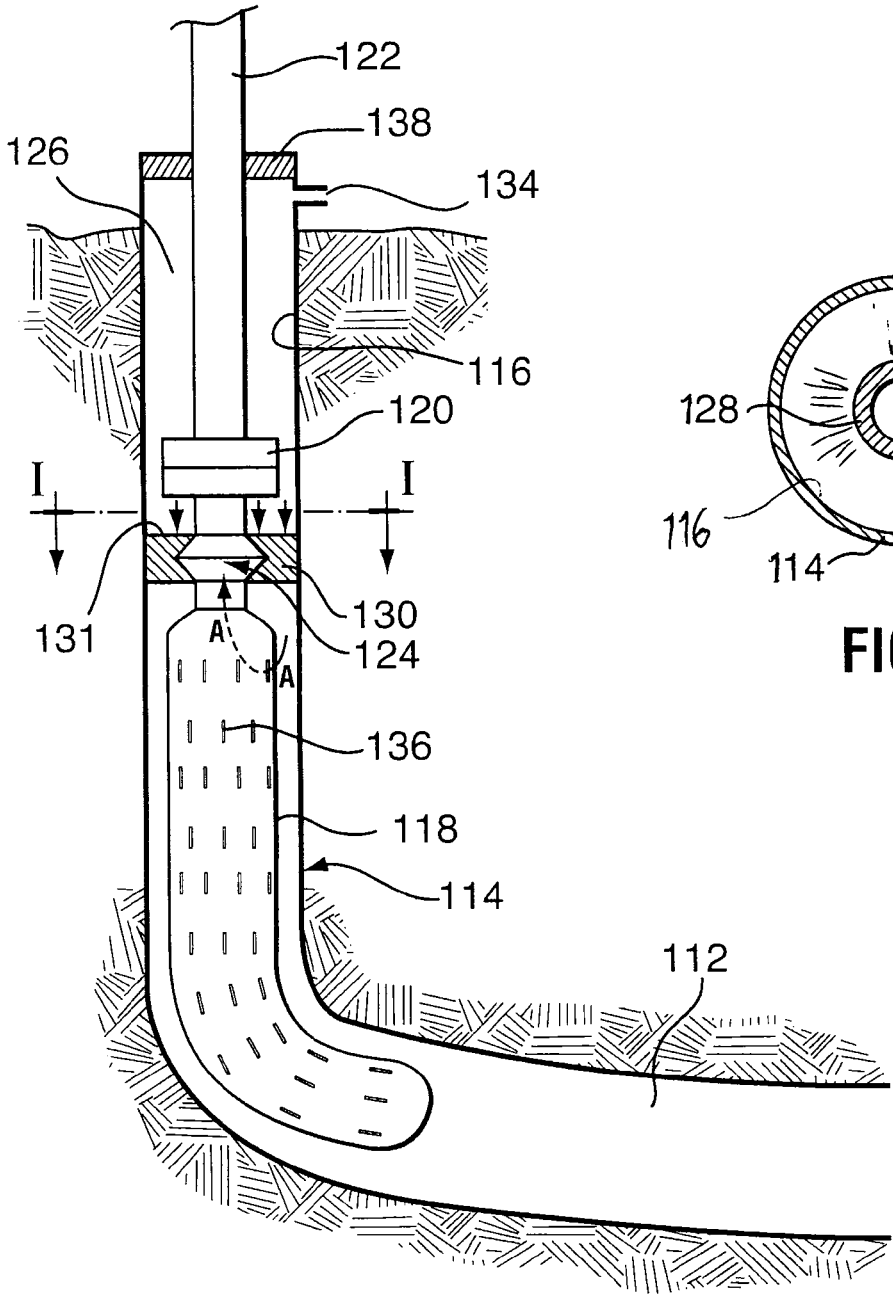
FIG. 1 is a schematic illustration of a borehole including an assembly for assisting the placement of a well bore liner.

With reference to FIG. 1, a borehole 112 is shown into which a well bore liner is being run. In the illustrated embodiment, the borehole 112 is lined along a portion of its length with casing 114 such that the well bore wall 116 coincides with the inner wall of the casing and thereby defines the casing inner diameter. It is to be understood however, that this may not always be the case. For example, the borehole could be unlined or the casing could be another form of well bore liner. Also in the illustrated embodiment, the liner 118 being run in is a slotted liner, but it is to be understood that the liner may take other forms such as a well bore screen, a solid liner, and so forth.

As is common, the liner 118 is connected below a liner hanger 120 and a drill string 122, but according to the present invention a liner placement assist tool 124 is positioned to create a seal in the annulus 126 between the liner 118 or drill string 122 and the well bore wall 116. Although the embodiment of FIG. 1 shows the liner placement assist tool 124 below the liner hanger 120, the tool can be positioned variously for example above or below the liner hanger and on the drill string or even about the liner being run in.

Figure 2:
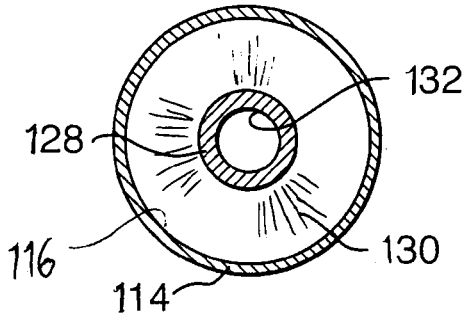
FIG. 2 is a section along line 1-1 of FIG. 1.

With reference also to FIG. 2, the liner placement assist tool 124 includes a tool body 128 and an annular seal 130 extending annularly about the tool body 128. The tool body 128 may include an axial channel or bore 132 extending between its ends such that when it is connected into a drill string or between the drill string and the liner, the bore 132 provides communication with the inner diameter of the drill string, thereby permitting flow of drilling fluid therethrough. The annular seal 130 may be selected to hold pressure in the annulus between the drill string and the casing inner wall 116 so that a pressure differential can be created on either side of the seal 130. An annular seal may take various forms. In one embodiment, the annular seal may include one or more swab cup seals, while in other embodiments the annular seal may include other flexible yet sealing elements.

Briefly with reference to FIG. 1, a well bore liner 118 may be run into a borehole 112 by inserting a well bore liner 118 into a borehole 112, the liner 118 is carried on a tubing string 122 such as the illustrated drill string, which carries an annular seal 130. The annular seal 130 creates a seal between the tubing string 122 and the borehole wall 116 which is capable of holding pressure in the annulus 126 between the tubing string 122 and the borehole wall 116. This allows the creation of a high fluid pressure region in the annulus 126 above the annular seal 130. The pressure exerted upon the upper surface area 131 of the annular seal 130 creates a force higher than opposing forces below the annular seal 130 such that the force applied against the annular seal 130, drives the liner 118 into the borehole 112.

Generally, the liner 118 will be run in to a particular depth first by applying force to the tubing string 122 to move the liner 118 into the borehole 112. However, if and when it is determined that further force applied through the tubing string 122 will be ineffectual or undesired, fluid can be pumped through an inlet 134 into the annulus 126 between the tubing string 122 and the borehole wall 116 to create a fluid pressure above the annular seal 130 which, acting upon the upper surface area 131 of the annular seal 130, creates a downward force greater than the opposing forces below the annular seal 130 and the annular seal 130 begins to act as a piston to drive the liner 118 further into the borehole. Any surface area of the tool body 128 or the annular seal 130 that extends beyond the outer diameter of the tubing string 122 may operate as a piston face. As will be appreciated, skilled workmen may be able to calculate the pressure holding capacity of an annular seal and force generating capability for tools of various sizes.

An embodiment of the method of the invention, with reference to FIG. 1, may include following:

1. Pick up a desired amount of well bore liner 118.
2. Install a liner placement assist tool 124 and a liner hanger 120 on top of the liner 118 and install this liner 118 and liner running assembly 110 on a tubing string 122. The liner placement assist tool 124 may have an annular seal 130 selected to create a seal in the annulus 126 between the tubing string 122 and the casing 114 of well bore into which the liner 118 is to be run.
3. Run the entire assembly in hole on a tubing string 122 using rig overhead equipment until the liner 118 reaches a predetermined resistance (that is, down drag). In this procedure, fluid displaced from below the liner placement assist tool can move back up about the end of the liner 118 or through the slots 136, see arrow A, where the liner 118 is a slotted liner and up through the tubing string 122 to surface, for example, to mud tanks. During this procedure the annulus 126 above the annular seal 130 may also be open such that fluid displaced above the annular seal by the tubing string can move up through the casing/tubing string annulus 126 to surface, for example to mud tanks.
4. Once predetermined resistance on the liner 118 is reached, the surface annulus around the drill string may be packed off (such as by pack-off 138) to close in the annulus 126 and fluid can be pumped through inlet 134 into the casing/drill string annulus 126 to increase pressure above the annular seal 130 of the liner placement assist tool 124. The fluid pressure on the annular seal 130 may be regulated to create sufficient force to drive the liner 118 down into the hole 112. However, as will be appreciated, the pressure may be regulated to avoid exceeding any pressure limits of the system including for example, any of: an annular seal pressure holding limit, a liner buckling limit, a surface pack off pressure limit, a liner placement assist tool pressure limit, a casing pressure limit, and/or a drill pipe or liner collapse limit.
5. Once the liner 118 is advanced sufficiently toward total depth, the tubing string 122 and any other components of interest may be retrieved to surface.

Of course, it is to be understood that embodiments of the method of the invention are not limited to the apparatus illustrated in FIG. 1.

In those embodiments of the inventive method in which the liner placement assist tool is retrieved to the surface, the annular seal may act to swab fluid from the casing. If swabbing is not desired, fluid may be circulated down through the tubing string into the liner to replace the fluid displaced by swabbing. Alternatively, other fluid replacement mechanisms may be provided in the tool, such as, without limitation, a valving system or fluid bypass. For example, with reference to FIG. 3, another embodiment of a liner placement assist tool 324 is shown including a tool body 328 formed for supporting a pair of annular swab cups 340. The tool 324 may optionally be provided with stabilizing elements 350 (including centralising elements), such as blades; in some embodiments, the annular swab cups may be adapted to fulfill such function. The tool body 328 also includes a main bore 332 extending from an upper threaded connection 342, into which a liner hanger or tubing or drill string may be connected, and a lower threaded connection 344, for connection of a liner hanger, drill string tubular or liner. The tool body 328 of FIG. 3 also includes one or more ports 346 (two are shown) extending alongside, but not in communication with, the main bore 332. Each port 346 may house a check valve 348 which permits circulation of fluid past the tool 324 upwardly through the annulus, as may be useful during run in of a liner. However, the check valve may be selected to hold pressure when applying annulus pressure to the swab cups 340 to drive the liner advancement toward bottom hole. In various other embodiments, other mechanisms for opening or closing ports may be employed, such as, without limitation, other types of valves.

In such an embodiment, retrieval of the tool may also create a swabbing effect on the hole. Thus, as noted above, the hole can be filled through the drill string as the tool is tripped out. Alternatively, or in addition, shearable-type check valves may be mounted in the ports. Alternatively, a sub of the pump-out variety can be run above the tool. Such a sub may be selectively openable to provide communication between the outer surface and the inner diameter of the drill string. This sub could be opened after the running assembly is disconnected from the liner such that communication could be provided from the annulus to the inside of the drill string allowing the fluid being swabbed above the liner placement assist tool to drain and fill the hole.

Since the liner placement assist tool may have an inner bore diameter which is smaller than the inner diameter of the liner, the tool may be beneficially run above the liner hanger and retrieved with the liner hanger running tool.

Figure 3:
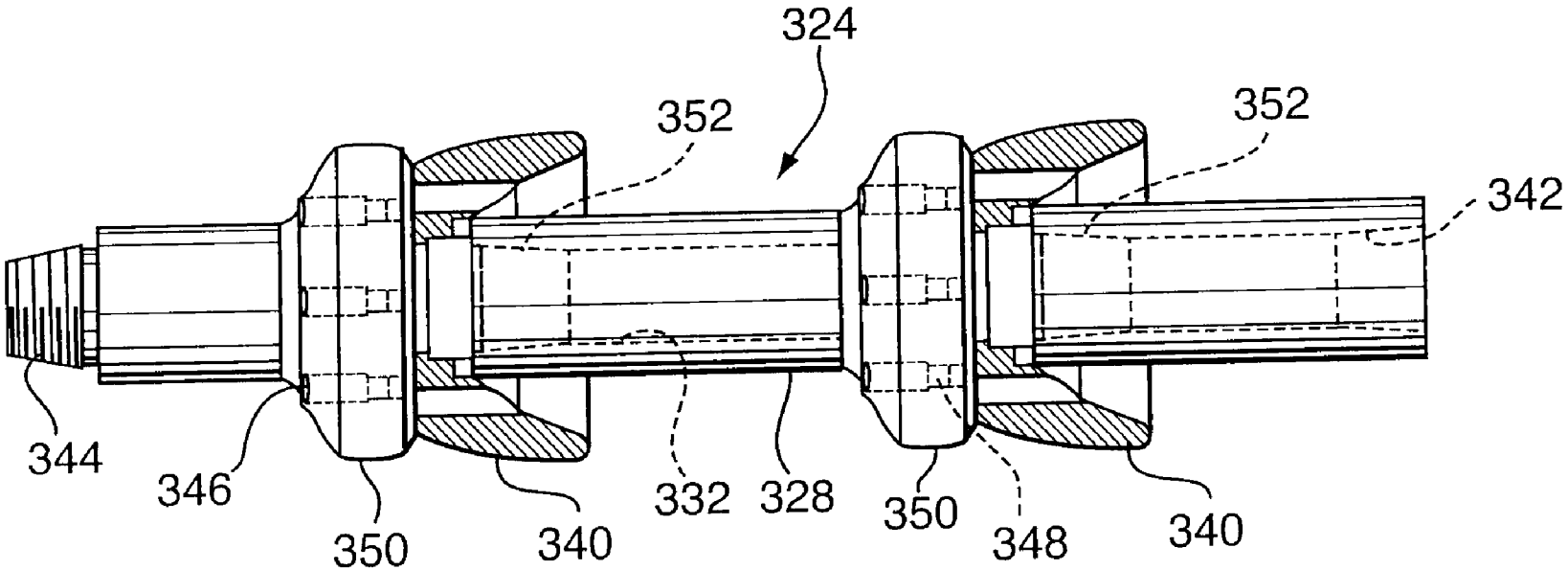
FIG. 3 is a schematic side elevation of an embodiment of a tool for assisting the placement of a well bore liner.

The liner placement tool may be formed in various ways. The embodiment of FIG. 3 illustrates that the tool may be formed in sections that are connected together such as by the threaded connections 352 to facilitate manufacture and assembly, but of course other connections (such as welded connections, etc.) could be used, or the tool could have a unitary or other type of construction.

Various embodiments have been described herein but are only to be considered illustrative, rather than limiting, of the invention. A skilled person will readily appreciate that various modifications can be made without departing from the spirit of the invention.

What is claimed is:

1. A method of placing a well bore liner, comprising:

(a) inserting a liner running assembly from surface into a well bore and defining an annulus between the liner running assembly and the well bore, the liner running assembly comprising a liner placement apparatus having an annular seal with an upper surface area, the annular seal extending radially about the liner placement apparatus for sealingly engaging the well bore, the liner placement apparatus engaging at an upper end thereof a tubing string and engaging at a lower end thereof a well bore liner, and the well bore having an inlet at surface;

(b) running the liner running assembly to a selected depth;

(c) packing off the annulus above the inlet;

(d) pumping fluid into the annulus through the inlet above the annular seal until fluid pressure on the upper surface area of the annular seal creates a force at least equal to opposing bottomhole forces below the annular seal;

(e) continuing to pump fluid into the annulus through the inlet to drive the liner down the well bore.

2. The method of claim 1, further comprising the steps of driving the liner down the well bore to a final depth and retrieving the tubing string.

3. The method of claim 2, further comprising circulating fluid from the tubing string into the liner for replacement of fluid displaced during retrieval of the tubing string.

4. The method of claim 3, further comprising retrieving the tubing string.

5. The method of claim 2, further comprising providing a fluid replacement mechanism.

6. The method of claim 5, the fluid replacement mechanism comprising valving.

7. The method of claim 5, the fluid replacement mechanism comprising a fluid bypass.

8. A method for running a well bore liner into a well bore having a wall, the method comprising:

(a) providing a liner and liner running assembly having:

(i) a tubing string, (ii) a liner retainer for holding the liner in place in the well bore, the liner and liner retainer being attached adjacent a lower end of the tubing string, and (iii) an annular seal selected to sealingly couple the liner running assembly and the well bore wall;

(b) running the liner and liner running assembly into the well bore;

(c) applying force to the tubing string to move the liner into the well bore; and, (d) pumping fluid into an annulus between the tubing string and the well bore wall to exert a fluid pressure on an upper surface area of the annular seal to drive the liner down into the well bore.

* * * * *